US010665939B2

(12) United States Patent
Avakian et al.

(10) Patent No.: US 10,665,939 B2
(45) Date of Patent: May 26, 2020

(54) SCANNING ANTENNA WITH ELECTRONICALLY RECONFIGURABLE SIGNAL FEED

(71) Applicant: SIERRA NEVADA CORPORATION, Sparks, NV (US)

(72) Inventors: Aramais Avakian, Lake Forest, CA (US); Lev S. Sadovnik, Irvine, CA (US)

(73) Assignee: SIERRA NEVADA CORPORATION, Sparks, NV (US)

( * ) Notice: Subject to any disclaimer, the term of this patent is extended or adjusted under 35 U.S.C. 154(b) by 80 days.

(21) Appl. No.: 15/949,816

(22) Filed: Apr. 10, 2018

(65) Prior Publication Data

US 2019/0312350 A1 Oct. 10, 2019

(51) Int. Cl.

| | |
|---|---|
| ***H01Q 3/00*** | (2006.01) |
| ***H01Q 3/24*** | (2006.01) |
| ***H01Q 1/50*** | (2006.01) |
| *H01Q 21/00* | (2006.01) |

(52) U.S. Cl.
CPC ..... *H01Q 3/247* (2013.01); *H01Q 1/50* (2013.01); *H01Q 21/0006* (2013.01)

(58) Field of Classification Search
CPC ..... H01Q 3/247; H01Q 1/50; H01Q 21/0006
USPC ..... 342/374, 371
See application file for complete search history.

(56) References Cited

U.S. PATENT DOCUMENTS

| | | | |
|---|---|---|---|
| 5,815,124 A | 9/1998 | Manasson et al. | |
| 5,959,589 A | 9/1999 | Sadovnik et al. | |
| 6,211,836 B1 | 4/2001 | Manasson et al. | |
| 6,750,827 B2 | 6/2004 | Manasson et al. | |
| 7,667,660 B2 * | 2/2010 | Manasson | H01Q 13/02 343/781 P |

(Continued)

FOREIGN PATENT DOCUMENTS

WO WO2016153459 9/2016

OTHER PUBLICATIONS

International Search Report on corresponding PCT application (PCT/US2019/025378) from International Searching Authority (USPTO) dated Jul. 5, 2019.

(Continued)

*Primary Examiner* — Chuong P Nguyen
(74) *Attorney, Agent, or Firm* — Klein, O'Neill & Singh, LLP

(57) ABSTRACT

A scanning antenna system includes a feed line having first and second ends, and a scanning antenna element disposed with respect to the feed line so that, in the transmit mode, a signal input to one of the first and second ends of the feed line is evanescently coupled to the antenna element, whereby the antenna element radiates the signal as a shaped beam through an angular scanning field having a negative angular scanning space and a positive angular scanning space on either side of the stop band near 0°. A switching network, operatively coupled to the feed line, switches the signal input between the first and second ends of the feed line in a controlled sequence, whereby the shaped beam radiated by the antenna element is scanned in the negative scanning space, the stop band, and the positive scanning space. The antenna system performs reciprocally in the receive mode.

14 Claims, 4 Drawing Sheets

(56) References Cited

U.S. PATENT DOCUMENTS

| | | | | |
|---|---|---|---|---|
| 8,629,813 | B2 * | 1/2014 | Milosavljevic | H01Q 1/243 343/850 |
| 9,070,975 | B2 * | 6/2015 | Collins | H01Q 1/242 |
| 9,153,867 | B2 * | 10/2015 | Kim | H01Q 9/145 |
| 9,553,361 | B2 * | 1/2017 | Hu | H01Q 1/243 |
| 9,711,841 | B2 * | 7/2017 | Yong | H01Q 1/243 |
| 2003/0073463 | A1 | 4/2003 | Shapira | |
| 2006/0244672 | A1 | 11/2006 | Avakian et al. | |
| 2007/0152868 | A1 | 7/2007 | Schoebel | |
| 2009/0059890 | A1 | 3/2009 | Cordeiro et al. | |
| 2009/0251382 | A1 * | 10/2009 | Umehara | H01Q 1/362 343/850 |
| 2012/0105295 | A1 | 5/2012 | Lin et al. | |
| 2012/0133571 | A1 * | 5/2012 | Collins | H01Q 1/242 343/860 |
| 2015/0116159 | A1 * | 4/2015 | Chen | H01Q 5/22 343/702 |
| 2016/0006092 | A1 | 1/2016 | Ueda et al. | |
| 2019/0058254 | A1 * | 2/2019 | Zhu | H01Q 9/045 |
| 2019/0181555 | A1 * | 6/2019 | Lee | H01Q 1/243 |

OTHER PUBLICATIONS

Written Opinion on corresponding PCT application (PCT/US2019/025378) from International Searching Authority (USPTO) dated Jul. 5, 2019.

* cited by examiner

SCANNING ANTENNA WITH ELECTRONICALLY RECONFIGURABLE SIGNAL FEED

CROSS REFERENCE TO RELATED APPLICATIONS

Not Applicable

FEDERALLY SPONSORED RESEARCH OR DEVELOPMENT

Not Applicable

BACKGROUND

This disclosure relates generally to the field of directional antennas for transmitting and/or receiving electromagnetic radiation, particularly (but not exclusively) microwave and millimeter wavelength radiation. More specifically, the disclosure relates to antennas with serial feed that transmit and/or receive a directionally shaped and steered electromagnetic beam that is formed along the path of the propagating in the feed electromagnetic signal. These antennas, commonly referred to as scanning antennas, are well-known in the art, as exemplified by U.S. Pat. Nos. 6,750,827; 6,211,836; 5,815,124; and 5,959,589, the disclosures of which are incorporated herein by reference. One class of these antennas, which may be termed dielectric waveguide fed antennas, operate in the transmit mode by the evanescent coupling of electromagnetic waves traveling in an elongate (typically rod-like) dielectric waveguide (or "feed line") to a scanning antenna element (typically, a rotating cylinder or drum), and then radiating the coupled electromagnetic energy in directions determined by surface features of the antenna element. Conversely, in the receive mode, the electromagnetic energy received from the free space by the antenna element is coupled into and travels in the dielectric waveguide. By defining rows of scattering features, wherein the features of each row have a different period, and by rotating the antenna element around an axis that is parallel to that of the waveguide, the radiation can be directed in a plane over an angular range determined by the different periods, thereby transmitting and/or receiving a highly directional beam with a desired beam shape.

In the context of this disclosure, the term "beam shape" encompasses the beam direction, which is defined by (a) the angular location of the power peak of the transmitted/received beam with respect to at least one given axis, (b) the beam width of the power peak, and (c) the side lobe distribution of the beam power curve.

Serial-feed scanning antennas are typically restricted to the first negative order of radiating space harmonics for transforming the guided electromagnetic signal energy to a single shaped beam propagating in free space with a given set of beam shape parameters and in a given direction. The scanning ability of such antennas is thus limited to the "negative" half space, meaning, generally, the angular portion of scanning range between the signal input to the waveguide and 0°, thus excluding the "positive" half space, meaning, generally, the angular portion of the scanning range between 0° and the end of the waveguide connected to an impedance-matching load. The scanning range, in fact, also typically excludes the zero-degree direction from the beam forming/scanning due to high constructive return interference in the "stop band" near the 0° scanning angle, and the low radiation efficiency commonly associated with such antennas.

It would therefore be an advance in the field of scanning antennas to provide a serial feed antenna that addresses the above-noted problem without undue complexity and in a cost-efficient manner. In particular, it would be advantageous to provide such an antenna with the ability to allow beam scanning in both halves (i.e., "negative" and "positive") of the scanning space.

SUMMARY

This disclosure relates to serial feed scanning antennas that can scan in both the positive and negative halves of the scanning space or field by switching the direction of propagation of the electromagnetic signal in the feed line. Such antennas may also provide a high gain broadside beam (in the vicinity of 0°, i.e., the "stop band") by supplying the electromagnetic signal on both sides of the feed line simultaneously, with equal amplitude. With the electromagnetic beam propagating in opposite directions with equal amplitude, the return interference becomes destructive, and the radiation efficiency in the broadside direction increases significantly. Feeding and scanning in both halves of the scanning space or field also provides for higher gains for the same angular range of the scan as compared to the gains typically achievable in known serially fed scanning antennas.

The above-described advantages are achieved in a scanning antenna system that includes a feed line having first and second ends, and a scanning antenna element disposed with respect to the feed line so that, in the transmit mode, an electromagnetic signal input to one of the first and second ends of the feed line is evanescently coupled to the antenna element, whereby the antenna element radiates the signal as a shaped beam through an angular scanning field having a negative angular scanning space and a positive angular scanning space on either side of the stop band near 0°. A switching network, operatively coupled to the feed line, switches the signal input between the first and second ends of the feed line in a controlled sequence, whereby the shaped beam radiated by the antenna element is scanned in the negative angular scanning space, the stop band, and the positive angular scanning space. The antenna system performs reciprocally in the receive mode.

Thus, a serial feed scanning antenna system in accordance with aspects of this disclosure comprises a scanning antenna element evanescently coupled to a waveguide or feed line, and a switching network operatively coupled to the feed line to switch the direction of propagation of the electromagnetic energy (signal) in the feed line during scanning in a controlled sequence so as to shape and scan the beam radiated from the antenna element in both the negative and positive angular scanning spaces of the angular scanning field. More specifically, assuming the scanning is done across angular scanning spaces on either side of 0° (the "stop band") (as a practical example, an angular scanning field of 90° from −45° to +45°, or vice versa), the signal is directed solely to a first end of the feed line from −45° until the scan gets to the "stop band", at which point the switching network directs the signal equally to both the first end of the feed line and an opposite second end thereof. Once the scan passes through the stop band, the switching network directs the signal solely to the second end of the feed line.

The switching network, in exemplary embodiments, includes a master switch assembly having an input terminal configured for connection to a signal source, and output terminals selectively connectable to a negative side scan switch assembly and to a positive side scan switch assembly, which direct the signal respectively to first and second opposed ends of a feed line that is evanescently coupled to a scanning antenna element. First and second output terminals of the master switch assembly are configured to direct the full signal respectively to the negative side scan switch assembly and the positive side scan switch assembly. A third output terminal of the master switch assembly is selectively connectable to both the negative side scan switch assembly and the positive side scan switch assembly simultaneously, thereby splitting the signal equally between the negative and positive side scan switch assemblies. The negative side scan switch assembly has an output terminal connected to the first end of the feed line, and the positive side scan switch assembly has an output terminal connected to the opposite second end of the feed line. The master switch assembly, the negative side scan switch assembly, and the positive side scan switch assembly are actuated in a prescribed sequence to direct all of the signal to the negative side scan switch assembly during scanning of the negative angular scanning space of the scanning field, then to direct half the signal to each of the negative and positive side scan switch assemblies while beam forming in the stop band takes place, and finally to direct all of the signal to the positive side scan switch assembly while scanning from the stop band through the positive angular scanning space of the angular scanning field.

In one mode of operation, the sequence is simply reversed (i.e., full signal to the positive scanning space, half signal to each of the positive and negative scanning spaces, full signal to the negative scanning space) as scanning returns to the negative limit of the scanning field from the positive limit. Alternatively, the scanning can transition back to the negative field limit after the positive field limit has been reached, and the original switching sequence (negative space-to-stopband-to positive space) can be repeated.

In some exemplary embodiments, the master switch assembly comprises a single pole triple throw (SP3T) switch. Each of the negative side scan switch assembly and the positive side scan switch assembly also comprises an SP3T switch, each of the SP3T switches having a full signal input terminal, a half signal input terminal, and a matched load terminal connected to an impedance-matched load. In operation, scanning of the negative scanning space is performed with a first output terminal of the master switch assembly connected to the full signal input terminal of the negative side scan switch assembly, while the positive side scan switch assembly is connected to its matched load terminal. The stop band scanning is performed with a second output terminal of the master switch assembly connected to the half signal input terminal of both the negative side scan switch assembly and the positive side scan switch assembly. The scanning of the positive scanning space is performed with a third output terminal of the master switch assembly connected to the full signal input of the positive side scan switch assembly, while the negative side scan switch assembly is connected to its matched load terminal.

In other exemplary embodiments, the master switch assembly comprises two single pole double throw (SPDT) master switches. A first SPDT master switch has an input terminal connected to a signal source, and two selectable output terminals. The first output terminal of the first SPDT switch is connected to the full signal input of one of the SP3T side scan switches (e.g., the positive side scan switch), while the second output terminal of the first SPDT master switch is connected to the input terminal of a second SPDT master switch. The second SPDT master switch has two selectable output terminals, one of which is connected to the full signal input of the other SP3T side scan switch (e.g., the negative side scan switch), and the other of which is connected to the half signal inputs of both SP3T side scan switches.

To perform the negative space scan, the first SPDT master switch is operated to connect serially to the second SPDT master switch, which is operated to connect to the full signal input of the negative SP3T side scan switch. Stop band scanning is performed by switching the second SPDT master switch to connect to the half signal inputs of both the SP3T side scan switches. The positive space scan is performed by switching the output of the first SPDT master switch from the second SPDT master switch to the full signal input of the positive SP3T side scan switch. Whichever of the SP3T side scan switches is not receiving input from one of the SPDT master switches is switched to be connected to its respective impedance-matched termination.

Other exemplary embodiments are similar to the previously-described embodiments with two SPDT master switches, except that each of the side scan switch assemblies comprises a serially-connected pair of SPDT switches. In these embodiments, a first SPDT negative side scan switch has a selectable full signal input terminal connected to a first selectable output terminal of the second SPDT master switch, and a selectable matched load terminal connected to an impedance-matched load. The output terminal of the first SPDT negative side scan switch is connected to one of two selectable input terminals of a second SPDT negative side scan switch, the other of which is a selectable half signal input connected to a second selectable output terminal of the second SPDT master switch. On the other side of the feed line, a first positive SPDT side scan switch has a selectable full signal input terminal connected to a selectable output terminal of the first SPDT master switch, and a selectable matched load terminal connected to an impedance-matched load. The output terminal of the first SPDT positive side scan switch is connected to one of two selectable inputs of a second SPDT positive side scan switch, the other of which is a selectable half signal input terminal connected to the second output terminal of the second SPDT master switch.

To perform the negative space scan, the first SPDT master switch is operated to connect serially to the second SPDT master switch. The second SPDT master switch and the first SPDT negative side scan switch are operated to connect the first selectable output terminal of the second SPDT master switch to the full signal input terminal of the first SPDT negative side scan switch. The first and second SPDT positive side scan switches are operated to connect the impedance-matched load to the positive end of the feed line. Stopband scanning is performed with the second output terminal of the second SPDT master switch, the second SPDT negative side scan switch, and the second SPDT positive side scan switch operated to connect the second selectable output terminal of the second SPDT master switch to the half signal input terminals of the second SPDT negative side scan switch and the second SPDT positive side scan switch. Finally, positive space scanning is performed by operating the first SPDT master switch, the first positive side SPDT switch, and the second SPDT positive side scan switch to connect the second selectable output terminal of the first SPDT master switch to the full signal input terminal of the first SPDT positive side scan switch, and to connect the first selectable input terminal of the second SPDT positive side scan switch to the output terminal of the first SPDT positive side scan switch. This will disconnect the second SPDT master switch from the first SPDT master switch. Also, the first and second SPDT negative side scan switches are operated to connect the negative side impedance-matched load to the negative end of the feed line.

It will be appreciated that the operation of the various switches used in the above embodiments may advantageously be operated in the desired sequence under the control of a suitably programmed electronic processor, or any other automated control system capable of coordinating the operation of the switches to provide the desired results. Such control systems and/or mechanisms are well-known in the art, and they will readily suggest themselves to those tasked with implementing the disclosed embodiments.

It should be understood that the terms "negative" and "positive," as applied to the angular scanning spaces on opposite sides of the stop band in this disclosure, are defined in relation to an arbitrarily-selected one of the ends of the feed line, as shown in the drawing Figures. Thus, these terms are used in this disclosure for the purpose of explaining the embodiments described herein, and not in any limiting way.

As will be more fully understood from the detailed description below, the embodiments described herein provide a directional signal scanned with a high degree of efficiency across the entire scanning field, from the negative scanning limit to the positive scanning limit, including the stop band. This result is achieved without adding significantly to the cost or complexity of the scanning antennas with which these embodiments will be implemented, and, importantly in some applications, without adding appreciably to the physical size or weight of such antennas.

DETAILED DESCRIPTION

Figure 1:
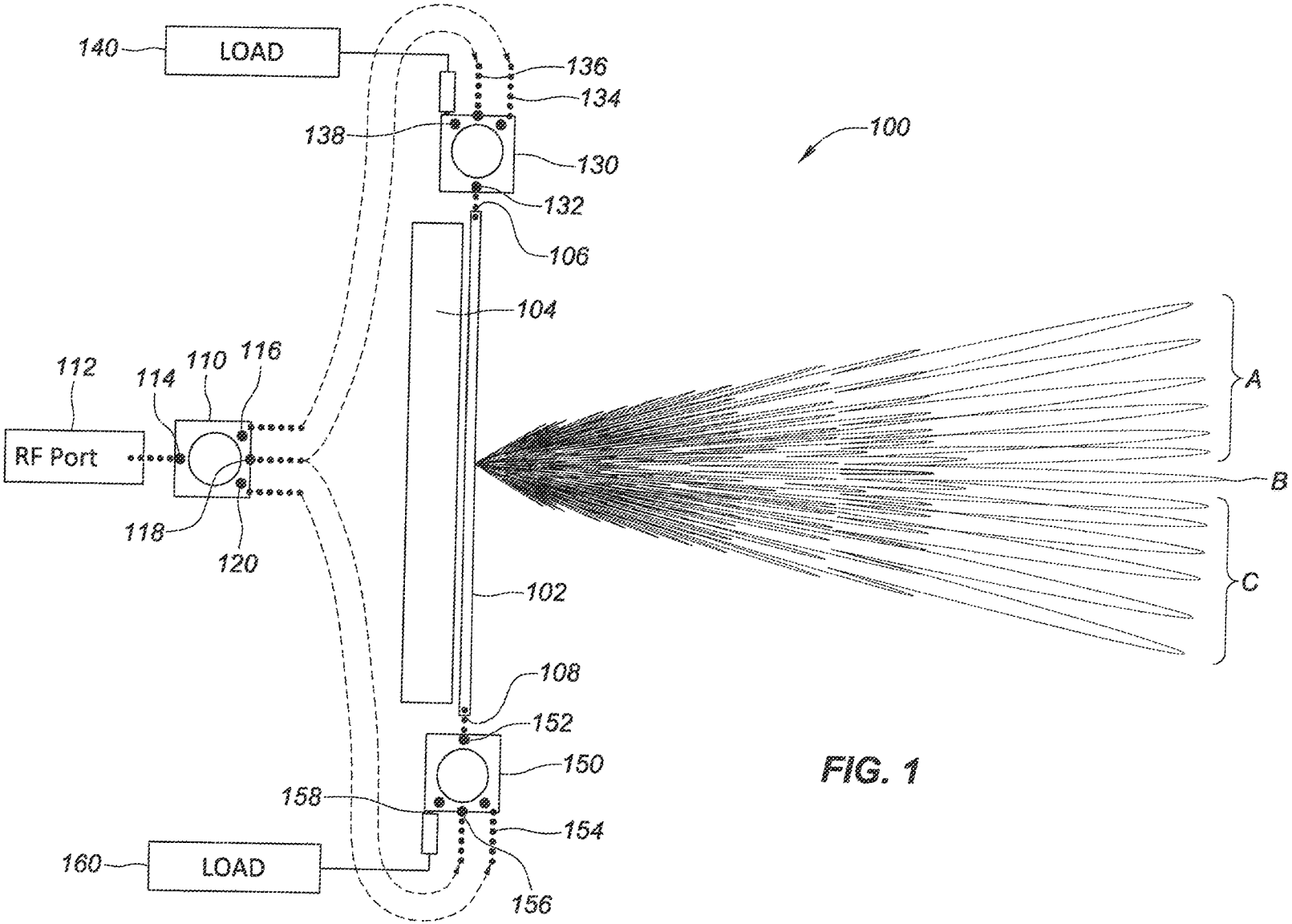
FIG. 1 is a schematic representation of a scanning antenna system with an electronically reconfigurable signal feed in accordance with a first exemplary embodiment of this disclosure.

Referring first to FIG. 1, a scanning antenna system 100, in accordance with certain embodiments of this disclosure is shown. The system 100 includes an RF or microwave signal feed line 102 that is evanescently coupled to a scanning antenna element 104, as is well-known in the art. The feed line 102 may be a conventional dielectric element, typically in the form of a rod, of the type commonly used in scanning antenna systems. The feed line 102 has a first end 106 and an opposite second end 108 into which a signal to be transmitted (in the transmission mode of operation) is injected by means of a switching network, as will be described below.

The scanning antenna element 104 scans the coupled electromagnetic signal from the first end 106 of the feed line 102 to the second end 108 of the feed line 102. The scanning field thus may be considered as spanning a 180° angular spectrum, from −90° at the first end 106 of the feed line 102 to +90° at the second end 108 of the feed line 102, thereby crossing through 0°. Alternatively, fields with less than a full 180° spectrum (e.g. a 90° spectrum from −45° to +45°) may be scanned. Thus, the first end 106 of the feed line 102 may be deemed, for the purpose of this discussion, the "negative" end, while the second end 108 of the feed line 102 may be deemed the "positive" end, although the application of terms "negative" and "positive" to the first end 106 and to the second end 108, respectively, is arbitrary, as mentioned in the Summary above. In either case, the scanning region in the proximity of 0° (and on either side thereof) may be termed the "stop band". The stop band may be defined as the angular range on either side of 0° in which the antenna Gain is reduced by 3 dB from its maximum value. Thus, in one exemplary embodiment, if the 3 dB Antenna Gain reduction occurs in a beamwidth of 1°, the stop band is defined (in this example) as 0°±0.5°.

In the embodiments according to FIG. 1, the switching network through which a signal is communicated to the feed line 102 comprises three single pole triple throw (SP3T) switches. A first SP3T switch 110, which may be considered a "master switch," receives an RF (or microwave) signal through a signal port 112 connected to an input terminal 114 that is a fixed contact of the master switch 110. As noted below, the system can be operated either in the transmission mode or the reception mode, whereby the signal port 112 can be in signal communication with a transmitter, receiver, or transceiver (not shown). The master switch 110 has first, second, and third selectable output terminals 116, 118, 120, respectively, to which the input terminal can be selectively connected.

A second SP3T switch 130 has a single output terminal 132 in the form of a fixed contact electrically coupled to the first or "negative" end 106 of the feed line 102. The second SP3T switch 130, which may be termed the "negative side scan switch," has first, second, and third selectable input terminals 134, 136, 138, respectively. The first input terminal 134 is a full signal input terminal that is connected to the first output terminal 116 of the master switch 110. The second input terminal 136 is a half signal input terminal that is connected to the second output terminal 118 of the master switch 110. The third input terminal 138 is a matched load terminal that is connected to a negative side impedance-matched load 140.

A third SP3T switch 150 has a single output terminal 152 in the form of a fixed contact electrically coupled to the second or "positive" end 108 of the feed line 102. The third SP3T switch 150, which may be termed the "positive side scan switch," has first, second, and third selectable input terminals 154, 156, 158, respectively. The first input terminal 154 is a full signal input terminal that is connected to the third output terminal 120 of the master switch 110. The second input terminal 156 is a half signal input terminal that is connected to the second output terminal 118 of the master switch 110. The third input terminal 158 is a matched load terminal that is connected to a positive side impedance-matched load 160.

In operation, a negative angular space scan (e.g., −45° to the stop band) is performed with the first output terminal 116 of the master switch 110 connected to the full signal input terminal 134 of the negative side scan switch 130, while the matched load terminal 158 of the positive side scan switch 150 is connected to its impedance-matched load 160. The stop band scanning (i.e., the portion of the scanning field including and proximate to 0°, as defined above) is performed with the second output terminal 118 of the master switch 110 connected both to the half signal input terminal 136 of the negative side scan switch 130 and the half signal input terminal 156 of the positive side scan switch 150. The positive space scanning (e.g., from the stop band to +45°) is performed with the third output terminal 120 of the master switch 110 connected to the full signal input terminal 154 of the positive side scan switch 150, while the matched load terminal 138 of the negative side scan switch 130 is connected to its impedance-matched load 140.

The resulting radiated beam shape, a simulated representation of which is shown in FIG. 1, is a highly-directional beam, in which the beam shape is symmetrical in both the negative space A of the angular scanning field and the positive scanning field C, and in which the stop band radiation B is of the highest theoretical magnitude throughout the angular scanning field. More specifically, the amplitude of the radiated beam is substantially equal in both spaces A and C of the scanning field, while the beam amplitude in the stop band B may approach, or even exceed the beam amplitude on either side of the stop band, up to the theoretical limit.

Figure 2:
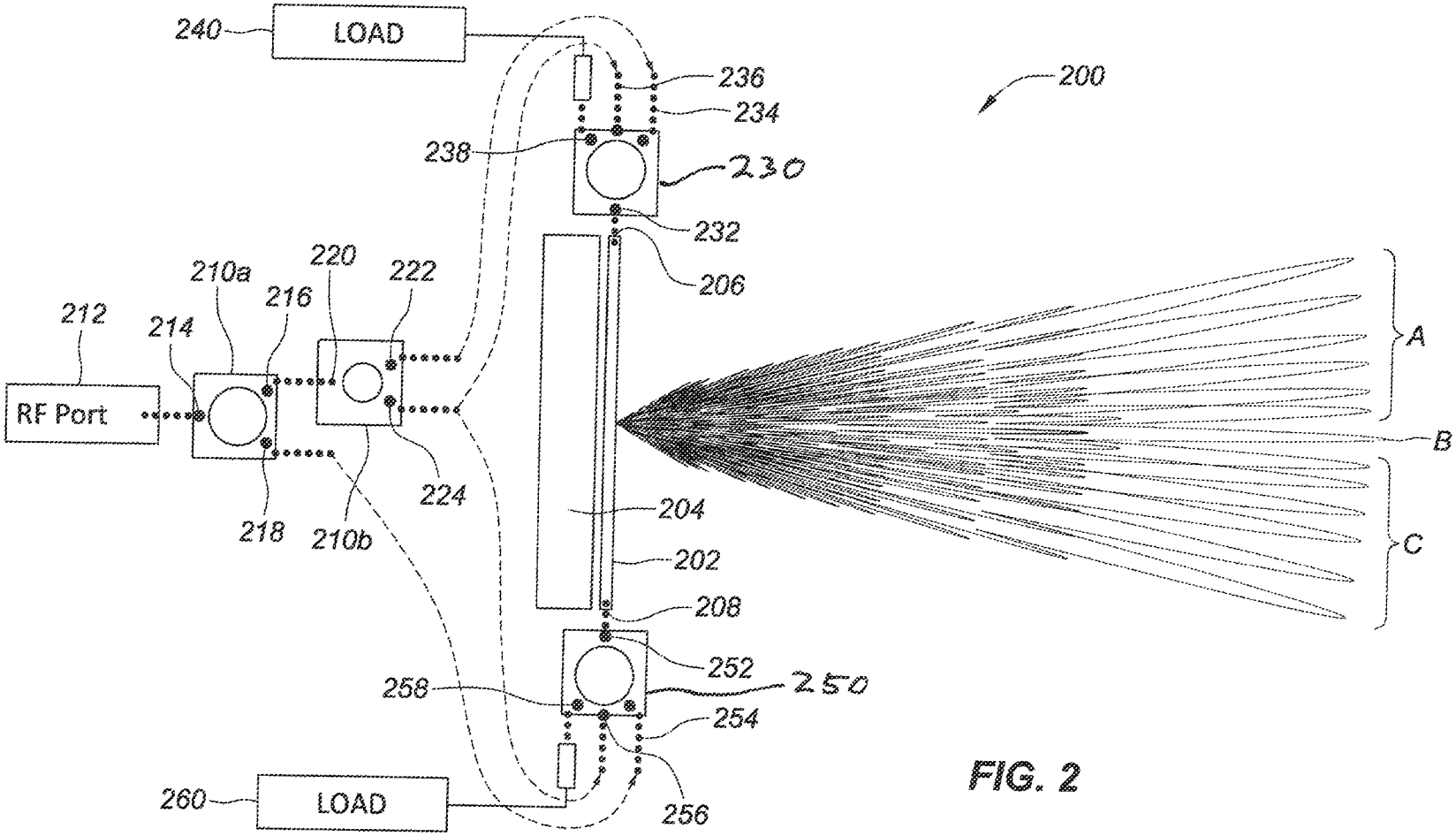
FIG. 2 is a schematic representation of a scanning antenna system with an electronically reconfigurable signal feed in accordance with a second exemplary embodiment of this disclosure.

Referring to FIG. 2, a scanning antenna system 200, in accordance with other embodiments of this disclosure is shown. The system 200 includes an RF or microwave signal feed line 202 that is evanescently coupled to a scanning antenna element 204. The feed line 202, again, may be a conventional dielectric element, typically in the form of a rod, of the type commonly used in scanning antenna systems. The feed line 202 has a first or "negative" end 206 and an opposite second or "positive" end 208 into which a signal to be transmitted is injected by means of a switching network, as will be described below.

In the embodiments according to FIG. 2, the switching network through which a signal is communicated to the feed line 202 comprises first and second master switches 210*a*, 210*b*, each configured as a single pole double throw (SPDT) switch. Negative and positive side scan switches 230, 250, respectively, are each configured as a single pole triple throw (SP3T) switch. The negative side scan switch 230 has a fixed contact output terminal 232 electrically coupled to the first or negative end 206 of the feed line 202; likewise, the positive side scan switch 250 has a fixed contact output terminal 252 electrically coupled to the second or positive end 208 of the feed line 202.

The first master switch 210*a* receives an RF (or microwave) signal through a signal port 212 connected to an input terminal 214 that is a fixed contact of the first master switch 210*a*. The first master switch 210*a* has first and second selectable output terminals 216, 218, respectively, to which the input terminal 214 can be selectively connected. The first output terminal 216 of the first master switch 210*a* is connected to a fixed contact input terminal 220 of the second master switch 210*b*. The second output terminal 218 of the first master switch 210*a* is connected to a selectable full signal input terminal 254 of the positive side scan switch 250.

The second master switch 210*b* has first and second selectable output terminals 222, 224, respectively. The first output terminal 222 of the second master switch 210*b* is connected to a selectable full signal input terminal 234 of the negative side scan switch 230. The second output terminal 224 of the second master switch 210*b* is connected both to a selectable half signal input terminal 236 of the negative side scan switch 230, and to a selectable half signal input terminal 256 of the positive side scan switch 250.

The negative side scan switch 230 has a third selectable input terminal 238 that is a matched load terminal connected to a negative side impedance-matched load 240. Similarly, the positive side scan switch 250 has a third selectable input terminal 258 that is a matched load terminal connected to a positive side impedance-matched load 260.

In embodiments in accordance with the system shown in FIG. 2, to perform the negative space scan (e.g., −45° to the stop band), the first master switch 210*a* is operated to connect its first output terminal 216 serially to the input terminal 220 of the second master switch 210*b*, which is operated to connect its first output terminal 222 to the full signal input 234 of the negative side scan switch 230. Stop band scanning is performed by switching the second master switch 210*b* to connect its second output terminal 224 to the half signal input 236 of negative side scan switch 230 and to the half signal input 256 of the positive side scan switch 250. The positive space scan (e.g., stop band to +45°) is performed by switching the first master switch 210*a* to connect to the full signal input 254 of the positive side scan switch 250 through the second output terminal 218 of the first master switch 210*a*. Whichever of the side scan switches 230, 250 is not receiving input from one of the master switches 210*a*, 210*b* is switched to be connected to its respective impedance-matched load 240, 260.

Again, the resulting radiated beam, a simulated representation of which is shown in FIG. 2, is a highly-directional beam, in which the beam shape is symmetrical in both the negative scanning space A and the positive scanning space C, and in which the stop band radiation B is of the highest theoretical magnitude throughout the angular scanning field. More specifically, the amplitude of propagated radiation beam is substantially equal in both halves A and C of the scanning field, while the beam amplitude in the stop band B may approach, or even exceed the beam amplitude on either side of the stop band, up to the theoretical limit.

Figure 3:
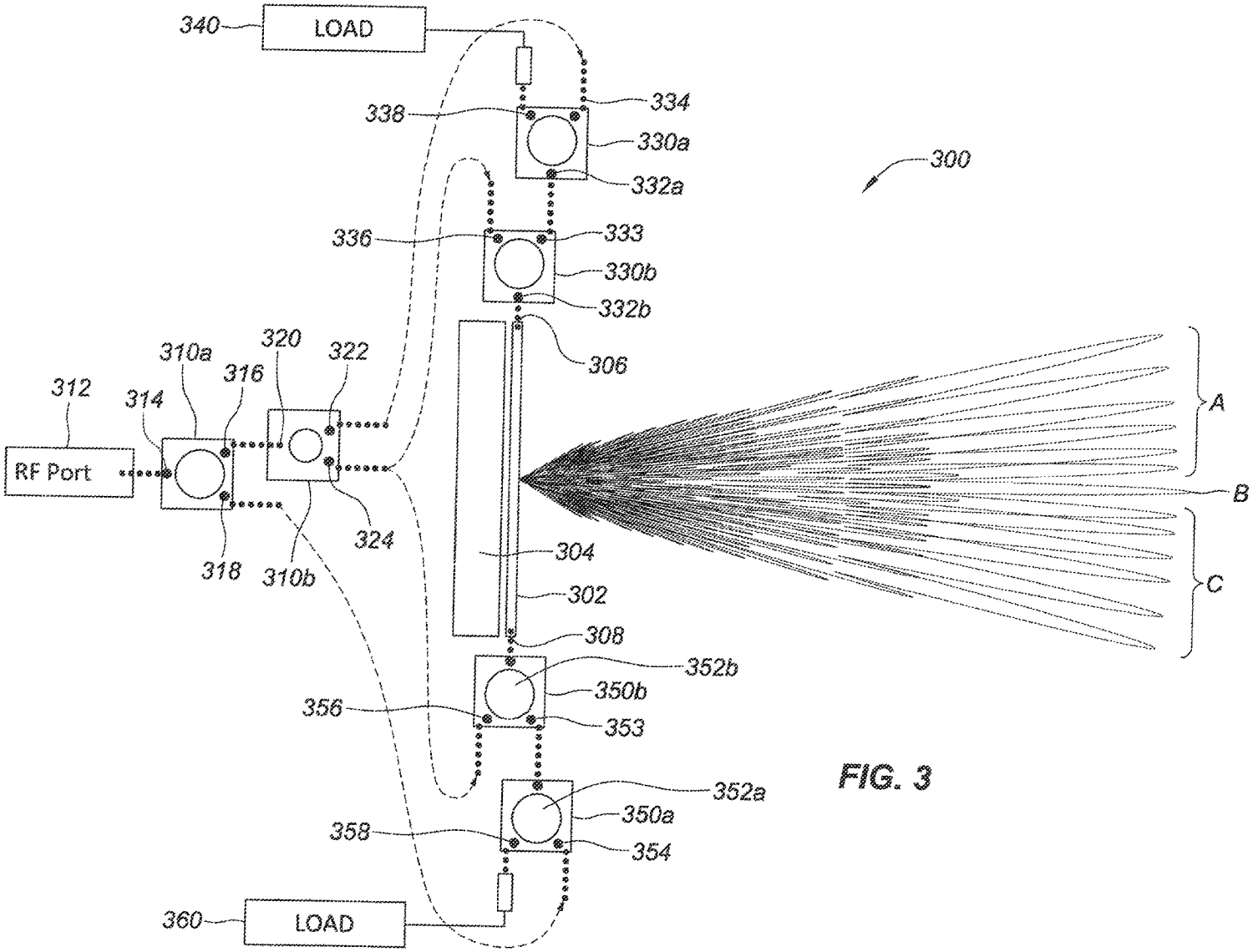
FIG. 3 is a schematic representation of a scanning antenna system with an electronically reconfigurable signal feed in accordance with a third exemplary embodiment of this disclosure.

Referring to FIG. 3, a scanning antenna system 300, in accordance with still other embodiments of this disclosure, is shown. The system 300 includes an RF or microwave signal feed line 302 that is evanescently coupled to a scanning antenna element 304. The feed line 302, again, may be a conventional dielectric element, typically in the form of a rod, of the type commonly used in scanning antenna systems. The feed line 302 has a first or "negative" end 306 and an opposite second or "positive" end 308 into which a signal to be transmitted is injected by means of a switching network, as will be described below.

In the embodiments according to FIG. 3, the switching network through which a signal is communicated to the feed line 302 comprises first and second master switches 310*a*, 310*b*, each configured as a single pole double throw (SPDT) switch. The network also comprises a negative side scan switch assembly comprising first and second negative side scan switches 330*a*, 330*b*, each configured as an SPDT switch, and a positive side scan switch assembly comprising first and second positive side scan switches 350*a*, 350*b*, which are also configured as SPDT switches. The first negative side scan switch 330*a* has a fixed contact output terminal 332*a* connected to a selectable first input terminal 333 of the second negative side scan switch 330*b*, which has a fixed contact output terminal 332*b* electrically coupled to the first or negative end 306 of the feed line 302. Likewise, the first positive side scan switch 350*a* has a fixed contact output terminal 352*a* connected to a selectable first input terminal 353 of the second positive side scan switch 350*b*, which has a fixed contact output terminal 352*b* electrically coupled to the second or positive end 308 of the feed line 302.

The first master switch 310*a* receives an RF (or microwave) signal through a signal port 312 connected to an input terminal 314 that is a fixed contact of the first master switch 310*a*. The first master switch 310*a* has first and second selectable output terminals 316, 318, respectively, to which the input terminal 314 can be selectively connected. The first output terminal 316 of the first master switch 310*a* is connected to a fixed contact input terminal 320 of the second master switch 310*b*. The second output terminal 318 of the first master switch 310*a* is connected to a selectable full signal input terminal 354 of the first positive side scan switch 350*a*.

The second master switch 310*b* has first and second selectable output terminals 322, 324, respectively. The first output terminal 322 of the second master switch 310*b* is connected to a selectable full signal input terminal 334 of the first negative side scan switch 330*a*. The second output terminal 324 of the second master switch 310*b* is connected both to a selectable half signal input terminal 336 of the second negative side scan switch 330*b*, and to a selectable half signal input terminal 356 of the second positive side scan switch 350*b*.

The first negative side scan switch 330*a* has a second selectable input terminal 338 that is a matched load terminal connected to a negative side impedance-matched load 340. Likewise, the first positive side scan switch has a second selectable input terminal 358 that is a matched load terminal connected to a positive side impedance-matched load 360.

In embodiments in accordance with the system shown in FIG. 3, to perform the negative space scan (e.g., −45° to the stop band), the first master switch 310*a* is operated to connect its first output terminal 316 serially to the input terminal 320 of the second master switch 310*b*, which is operated to connect its first output terminal 322 to the full signal input 334 of the first negative side scan switch 330*a*. The second negative side scan switch 330*b* is operated to connect its first input terminal 333 to the output terminal 332 of the first negative side scan switch 330*a*. As a result, the signal is conducted from the source 312 to the negative end 308 of the feed line 302 through the first master switch 310*a*, the second master switch 310*b*, the first negative side scan switch 330*a*, and the second negative side scan switch 330*b*. Stop band scanning is performed by switching the second master switch 310*b* to connect its second output terminal 324 to the half signal input 336 of the second negative side scan switch 330*b* and to the half signal input 356 of the second positive side scan switch 350*b*. This splits the signal equally for input to both the negative end 306 and the positive end 308 of the feed line 302 from the master switch assembly 310*a*, 310*b* and the second negative and positive side scan switches 330*a*, 330*b*. The positive space scan (e.g., stop band to +45°) is performed by operating the first master switch 310*a* to connect its second output terminal 318 to the full signal input 354 of the first positive side scan switch 350. Whichever of the first negative and positive side scan switches 330*a*, 350*b* is not receiving input from one of the master switches 310*a*, 310*b* is switched to be connected to its respective impedance-matched load 340, 360.

Again, the resulting radiated beam from the antenna element 304, a simulated representation of which is shown in FIG. 3, is a highly-directional beam, in which the beam shape is symmetrical in both the negative scanning field A and the positive scanning space C, and in which the stop band radiation B is of the highest theoretical magnitude throughout the angular scanning field. More specifically, the amplitude of radiated beam is substantially equal in both spaces A and C of the scanning field, while the beam amplitude in the stop band B may approach, or even exceed the beam amplitude on either side of the stop band, up to the theoretical limit.

Figure 4:
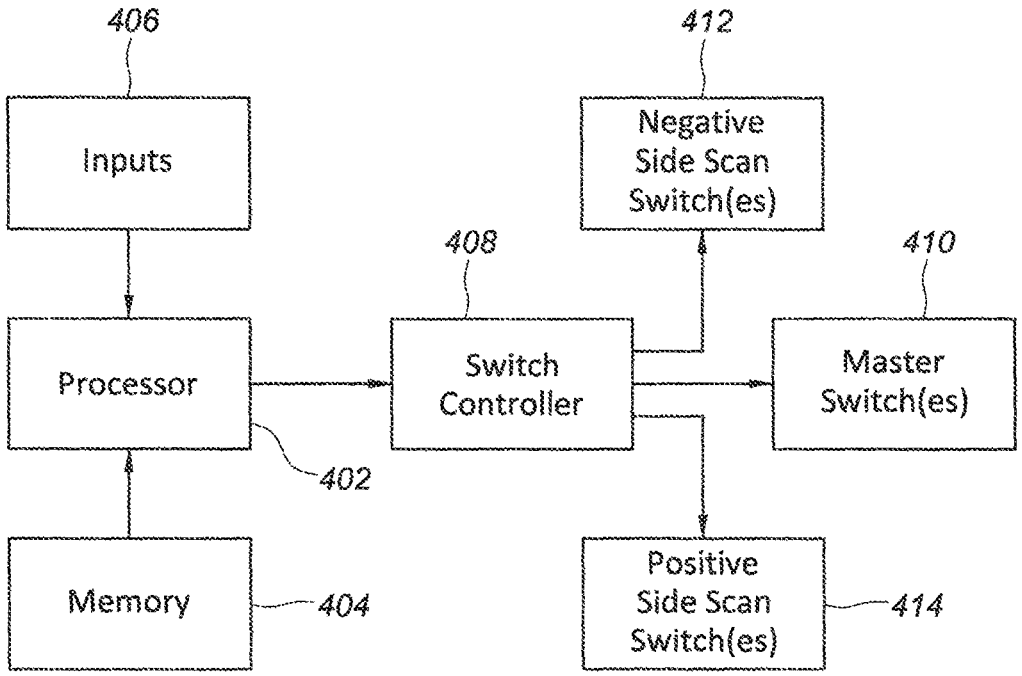
FIG. 4 is a schematic representation of an exemplary control system for use with the scanning antenna systems disclosed herein.

FIG. 4 represents an exemplary control system 400 for the scanning antenna systems disclosed herein, wherein the some or (preferably) all the switches and switching functions in the embodiments described above may advantageously be actuated or operated under the control of a suitably-programmed electronic processor 402. The processor 402 may read an operating program from an integrated resident memory module, or it may receive the program from a separate memory module 404. The processor may also receive other operational parameters from an input module 406. In operation under the control of the operating program, the processor 402 is configured to send appropriate output signals to a switch control network or module 408, which, in turn, signals the operation of the master switch(es) 410, the negative side scan switch(es) 412, and the positive side scan switch(es) 414.

The operating program is configured to operate or actuate the various switches in an appropriate sequence so as to be coordinated with the scanning motion (i.e., rotation) of the antenna element, whereby the desired beam shapes (as shown, for example, in FIGS. 1-3) are achieved. The particular operating program used will depend on which of the several embodiments of the scanning antenna systems described herein is used, and on the particular beam shape desired. In any case, the creation of an appropriate operating program is well within the ordinary skill in the relevant arts.

The systems described above have been described in the transmission mode of operation. It will be appreciated that their operation in the reception mode will be the reciprocal of the transmission mode, to which the drawing Figures are equally applicable. Thus, in the reception mode, the scanning antenna elements 104, 204, 304 receive a signal across the angular scanning field, and the received signal is evanescently coupled to the feed line 102, 202, 302, from which the signal is directed to the signal port 112, 212, 312 by the switching network so as to receive the incoming signal across the full angular scanning field, including the stop band.

What is claimed is:

1. A scanning antenna system, comprising:

a feed line having first and second ends;

a scanning antenna element disposed with respect to the feed line so that an electromagnetic signal input to one of the first and second ends of the feed line is evanescently coupled to the scanning antenna element, whereby the scanning antenna element is configured to radiate or receive the electromagnetic signal as a shaped beam through an angular scanning field having a stop band, a negative scanning space on a first side of the stop band, and a positive scanning space on a second side of the stop band; and a switching network operatively coupled to the feed line and configured to switch the electromagnetic signal input to or from the feed line between the first end of the feed line and the second end of the feed line in a controlled sequence, whereby the shaped beam radiated or received by the scanning antenna element is scanned in the negative scanning space, the stop band, and the positive scanning space.

2. The scanning antenna system of claim 1, wherein the switching network comprises:

a master switch assembly having an input terminal configured for connection to a signal port, and first, second, and third selectable output terminals;

a negative side scan switch assembly having an output terminal connected to the first end of the feed line, a first selectable input terminal connected to the first output terminal of the master switch assembly, a second selectable input terminal connected to the second output terminal of the master switch assembly, and a third selectable terminal connected to an impedance-matched load; and a positive side scan switch assembly having an output terminal connected to the second end of the feed line, a first selectable input terminal connected to the third output terminal of the master switch assembly, a second selectable input terminal connected to the second output terminal of the master switch assembly, and a third selectable terminal connected to an impedance-matched load.

3. The scanning antenna system of claim 2, wherein the first and third selectable output terminals of the master switch assembly are configured to direct the signal respectively to the first selectable input of the negative side scan switch assembly and to the first selectable input of the positive side scan switch assembly, and wherein the second selectable output terminal of the master switch assembly is configured to direct half the signal to each of the second input terminal of the negative side scan switch assembly and the second input terminal of the positive side scan switch assembly.

4. The scanning antenna system of claim 1, wherein the switching network is configured to be actuated in a prescribed sequence to direct the signal to the negative side scan switch assembly when the antenna element is scanning through the negative space of the scanning field, then to direct half the signal to each of the negative and positive side scan switch assemblies while the antenna element is scanning in the stop band, and then to direct the signal to the positive side scan switch assembly while the antenna element scanning from the stop band through the positive space of the scanning field.

5. The scanning antenna system of claim 1, wherein each of the negative side scan switch assembly and the positive side scan switch assembly comprises a single pole triple throw (SP3T) switch.

6. The scanning antenna system of claim 5, wherein the master switch assembly comprises a SP3T switch.

7. The scanning antenna system of claim 5, wherein the master switch assembly comprises first and second serially-connected single pole double throw (SPDT) master switches; wherein the first master switch has an input terminal configured to be connected to the signal port, a first selectable output terminal connected to an input terminal of the second master switch, and a second selectable output terminal configured as the third selectable output terminal of the master switch assembly; and wherein the second master switch has a first selectable output terminal configured as the first selectable output terminal of the master switch assembly, and a second selectable output terminal configured as the second selectable output terminal of the master switch assembly.

8. The scanning antenna system of claim 1, wherein the negative side scan switch assembly comprises first and second serially-connected SPDT negative side scan switches, and wherein the positive side scan switch assembly comprises first and second serially-connected SPDT positive side scan switches.

9. The scanning antenna system of claim 8, wherein the master switch assembly comprises first and second serially-connected single pole double throw (SPDT) master switches; wherein the first master switch has an input terminal configured to be connected to the signal port, a first selectable output terminal connected to an input terminal of the second master switch, and a second selectable output terminal configured as the third selectable output terminal of the master switch assembly; and wherein the second master switch has a first selectable output terminal configured as the first selectable output terminal of the master switch assembly, and a second selectable output terminal configured as the second selectable output terminal of the master switch assembly.

10. The scanning antenna system of claim 9, wherein the first negative side scan switch includes an output terminal connected to a first selectable input terminal of the second negative side scan switch, a first selectable input terminal connected to the first selectable output terminal of the second master switch, and a second selectable impedance matching terminal; wherein the second negative side scan switch includes an output terminal connected to the first end of the feed line, and a second selectable input terminal connected to the second selectable output terminal of the second master switch; wherein the first positive side scan switch includes an output terminal connected to a first selectable input terminal of the second positive side scan switch, a first selectable input terminal connected to the second selectable output terminal of the first master switch, and a second selectable impedance matching terminal; and wherein the second positive side scan switch includes an output terminal connected to the second end of the feed line, and a second selectable input terminal connected to the second selectable output terminal of the second master switch.

11. A method of operating a scanning antenna system including a scanning antenna element evanescently coupled to a feed line having first and second opposed ends, wherein the antenna element is configured to radiate or receive an electromagnetic beam across an angular scanning field having a first angular scanning space, a second angular scanning space, and a stop band between the first and second field angular scanning spaces, wherein the method comprises:

using a switching network operatively connected to the feed line to:

direct a signal solely to the first end of the feed line while the antenna element scans from the first scanning space to the stop band;

direct equal parts of the signal simultaneously to the first and second ends of the feed line while the antenna element scans through the stop band; and direct the signal solely to the second end of the feed line while the antenna element scans from the stop band through the second scanning space.

12. The method of claim 11, wherein the switching network comprises a plurality of switches operable in a controlled sequence to provide a radiated or received beam of substantially equal amplitude in each of the first and second scanning spaces.

13. The method of claim 12, wherein the switches in the switching network are operable in a controlled sequence to provide a radiated or received beam in the stop band that is of at least substantially the same amplitude as the radiated or received beam in the first and second scanning spaces.

14. The method of claim 11, wherein the switching network comprises a master switch assembly, a first side scan switch assembly, and a second side scan switch assembly;

wherein the master switch assembly has an input coupled to a signal port, a first selectable output connected solely to a first selectable input of the first side scan switch assembly, a second selectable output connected solely to a first selectable input of the second side switch assembly, and a third selectable output connected to a second selectable input of the first side switch assembly and a second selectable input of the second side switch assembly; and wherein the first side scan switch assembly has an output connected to the first end of the feed line, and the second side scan switch assembly has an output connected to the second end of the feed line.

* * * * *